US011097337B2

(12) United States Patent
Yang et al.

(10) Patent No.: US 11,097,337 B2
(45) Date of Patent: Aug. 24, 2021

(54) THERMAL PROCESSING OF CYLINDER LINERS

(71) Applicant: GM Global Technology Operations LLC, Detroit, MI (US)

(72) Inventors: Jianghuai Yang, Rochester Hills, MI (US); Qigui Wang, Rochester Hills, MI (US); Dale A Gerard, Bloomfield Hills, MI (US); Michael J Braskich, Grosse Ile, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 38 days.

(21) Appl. No.: 16/363,526

(22) Filed: Mar. 25, 2019

(65) Prior Publication Data

US 2020/0306825 A1 Oct. 1, 2020

(51) Int. Cl.

| | |
|---|---|
| ***B22D 19/00*** | (2006.01) |
| ***F02F 1/00*** | (2006.01) |
| ***F02B 77/04*** | (2006.01) |

(52) U.S. Cl.
CPC ..... *B22D 19/0081* (2013.01); *B22D 19/0009* (2013.01); *F02B 77/04* (2013.01); *F02F 1/004* (2013.01)

(58) Field of Classification Search
CPC . B22D 19/0009; B22D 19/0081; F02F 1/004; F02B 77/04
See application file for complete search history.

(56) References Cited

U.S. PATENT DOCUMENTS 5,333,668 A * 8/1994 Jorstad ..... B22D 19/0009 164/100
7,013,947 B1 * 3/2006 Stahl, Jr. ..... B22D 19/0009 164/103

* cited by examiner

*Primary Examiner* — Moshe Wilensky
*Assistant Examiner* — Kyle A Cook

(57) ABSTRACT

A method of manufacturing a cylinder block for an engine comprises providing a cylinder liner for the cylinder block and keeping the cylinder liner in a controlled atmosphere, removing the cylinder liner from the controlled atmosphere, removing moisture and gaseous contamination from the cylinder liner, and positioning the cylinder liner in a mold and over-casting a cylinder block in the mold.

7 Claims, 2 Drawing Sheets

THERMAL PROCESSING OF CYLINDER LINERS

The present disclosure relates to thermal processing of cylinder liners for an engine block.

Engine blocks for internal combustion engines, such as those engines adapted to be installed in vehicles, such as automobiles, have for a long time been made of cast iron for the necessary rigidity, and also for resistance to cylinder wear caused by the rapid sliding movement within a cylinder bore of a cylindrical piston having several piston rings. The use of cast iron results in a very heavy engine which, because of its weight, requires increased fuel consumption to operate the automobile, which runs counter to the modern trend of providing lighter weight automobiles and lighter weight engines for increased fuel economy.

One way to provide a lighter engine is to make the engine block from an aluminum alloy that has the required strength and wear attributes, because aluminum alloys have a considerably lower density which results in lighter weight. Although aluminum alloys are available that are suitable for casting and that have the required resistance to wear to ensure long, trouble-free engine life, at times it might be desirable to provide an engine block formed from an aluminum alloy and a cylinder liner that is formed from cast iron.

Known methods of forming an aluminum engine block having cast iron or steel cylinder liners is to cast the aluminum block around the cylinder liners to create an aluminum block with cast-in-place cylinder liners made from cast iron or steel. The liners are typically supported on a decomposable sand-type core within a casting cavity of a cylinder block casting mold, such as in sand casting or on a metal mandrel core in permanent mold or high pressure die casting, and with the outer surface of the liners exposed for cast-in-place joinder with the aluminum cylinder block. This process creates a mechanical bond between the cast-in-place cylinder liners and the block.

During the casting of the aluminum engine block around the cast iron or steel cylinder liners, migration of contamination from the cylinder liners into the molten aluminum may create imperfections in the aluminum cylinder block. Moisture and gaseous contamination in the cast iron cylinder liners includes, particularly, but is not limited to, hydrogen gas that is either absorbed by the cast iron cylinder liner or is created from moisture present in the cast iron cylinder liner. Hydrogen, in particular, may migrate from the cast iron into the molten aluminum during casting of the engine block. Hydrogen bubbles in finished cast aluminum block may lead to aluminum oxide bifilm trail and massive gas porosity.

Further, migrating gasses from the cast iron cylinder liner during the casting process may become trapped between the cylinder liner and the aluminum engine block, compromising the mechanical bond between the cylinder liner and the engine block.

Thus, while current techniques for creating aluminum engine blocks with cast-in-place iron cylinder liners achieve their intended purpose, there is a need for a new and improved method for thermal treatment of the cylinder liners prior to the casting of the engine block to remove moisture and gaseous contamination.

SUMMARY

According to several aspects of the present disclosure, a method of manufacturing a cylinder block for an engine comprises providing a cylinder liner for the cylinder block and keeping the cylinder liner in a controlled atmosphere, removing the cylinder liner from the controlled atmosphere, removing moisture and gaseous contamination from the cylinder liner, and positioning the cylinder liner in a mold and over-casting a cylinder block in the mold.

According to another aspect of the present disclosure, the method further comprises surface treating the cylinder liner prior to removing moisture and gaseous contamination from the cylinder liner.

According to another aspect of the present disclosure, surface treating the cylinder liner prior to removing moisture and gaseous contamination from the cylinder liner further includes shot blasting the surface of the cylinder liner.

According to another aspect of the present disclosure, the method further comprises surface treating the cylinder liner after removing moisture and gaseous contamination from the cylinder liner and prior to positioning the cylinder liner in a mold and over-casting a cylinder block in the mold.

According to another aspect of the present disclosure, surface treating the cylinder liner after removing moisture and gaseous contamination from the cylinder liner and prior to positioning the cylinder liner in a mold and over-casting a cylinder block in the mold further comprises shot blasting the surface of the cylinder liner.

According to another aspect of the present disclosure, surface treating the cylinder liner after removing moisture and gaseous contamination from the cylinder liner and prior to positioning the cylinder liner in a mold and over-casting a cylinder block in the mold further comprises surface treating the cylinder liner after removing moisture and gaseous contamination from the cylinder liner and no more than 8 hours prior to positioning the cylinder liner in a mold and over-casting a cylinder block in the mold.

According to another aspect of the present disclosure, removing moisture and gaseous contamination from the cylinder liner further comprises thermal processing the cylinder liner.

According to another aspect of the present disclosure, thermal processing the cylinder liner further comprises placing the cylinder liner in a controlled atmosphere and heat treating the cylinder liner within the controlled atmosphere.

According to another aspect of the present disclosure, thermal processing the cylinder liner further comprises heating the cylinder liner to a temperature between 200 degrees Celsius and 260 degrees Celsius, holding the cylinder liner at a temperature between 200 degrees Celsius and 260 degrees Celsius for at least 6 hours, and allowing the cylinder liner to cool to room temperature.

According to another aspect of the present disclosure, thermal processing the cylinder liner further comprises heating the cylinder liner to a temperature between 400 degrees Celsius and 450 degrees Celsius, holding the cylinder liner at a temperature between 400 degrees Celsius and 450 degrees Celsius for at least 1 hour, cooling the cylinder liner to a temperature between 200 degrees Celsius and 260 degrees Celsius, holding the cylinder liner at a temperature between 200 degrees Celsius and 260 degrees Celsius for at least 2 hours, and allowing the cylinder liner to cool to room temperature.

According to another aspect of the present disclosure, thermal processing the cylinder liner further comprises heating the cylinder liner to a temperature between 200 degrees Celsius and 260 degrees Celsius, holding the cylinder liner at a temperature between 200 degrees Celsius and 260 degrees Celsius for at least 1 hour, heating the cylinder liner to a temperature between 400 degrees Celsius and 450 degrees Celsius, holding the cylinder liner at a temperature between 400 degrees Celsius and 450 degrees Celsius for at least 1 hour, and allowing the cylinder liner to cool to room temperature.

According to several aspect of the present disclosure, a method of thermal processing a cylinder liner for an engine block comprises surface treating the cylinder liner, removing moisture and gaseous contamination from the cylinder liner, and surface treating the cylinder liner.

According to another aspect of the present disclosure, surface treating the cylinder liner prior to removing moisture and gaseous contamination from the cylinder liner further includes shot blasting the surface of the cylinder liner.

According to another aspect of the present disclosure, surface treating the cylinder liner after removing moisture and gaseous contamination from the cylinder liner further includes shot blasting the surface of the cylinder liner.

According to another aspect of the present disclosure, removing moisture and gaseous contamination from the cylinder liner further comprises thermal processing the cylinder liner.

According to another aspect of the present disclosure, thermal processing the cylinder liner further comprises placing the cylinder liner in a controlled atmosphere and heat treating the cylinder liner within the controlled atmosphere.

According to another aspect of the present disclosure, thermal processing the cylinder liner further comprises heating the cylinder liner to a temperature between 200 degrees Celsius and 260 degrees Celsius, holding the cylinder liner at a temperature between 200 degrees Celsius and 260 degrees Celsius for at least 6 hours, and allowing the cylinder liner to cool to room temperature.

According to another aspect of the present disclosure, thermal processing the cylinder liner further comprises heating the cylinder liner to a temperature between 400 degrees Celsius and 450 degrees Celsius, holding the cylinder liner at a temperature between 400 degrees Celsius and 450 degrees Celsius for at least 1 hour, cooling the cylinder liner to a temperature between 200 degrees Celsius and 260 degrees Celsius, holding the cylinder liner at a temperature between 200 degrees Celsius and 260 degrees Celsius for at least 2 hours, and allowing the cylinder liner to cool to room temperature.

According to another aspect of the present disclosure, thermal processing the cylinder liner further comprises heating the cylinder liner to a temperature between 200 degrees Celsius and 260 degrees Celsius, holding the cylinder liner at a temperature between 200 degrees Celsius and 260 degrees Celsius for at least 1 hour, heating the cylinder liner to a temperature between 400 degrees Celsius and 450 degrees Celsius, holding the cylinder liner at a temperature between 400 degrees Celsius and 450 degrees Celsius for at least 1 hour, and allowing the cylinder liner to cool to room temperature.

According to several aspects of the present disclosure, a method of manufacturing a cylinder block for an engine comprises providing a cylinder liner for the cylinder block and keeping the cylinder liner in a controlled atmosphere, removing the cylinder liner from the controlled atmosphere, and shot blasting the surface of the cylinder liner. Removing moisture and gaseous contamination from the cylinder liner by thermal processing the cylinder liner according to one of heating the cylinder liner to a temperature between 200 degrees Celsius and 260 degrees Celsius for at least 6 hours and returning to room temperature; heating the cylinder liner to a temperature between 400 degrees Celsius and 450 degrees Celsius for at least one hour, cooling the cylinder liner to a temperature between 200 degrees Celsius and 260 degrees Celsius for at least 2 hours, and returning to room temperature; and heating the cylinder liner to a temperature between 200 degrees Celsius and 260 degrees Celsius for at least 1 hour, further heating the cylinder liner to a temperature between 400 degrees Celsius and 450 degrees Celsius for at least 1 hour, and cooling the cylinder liner to room temperature. Shot blasting the surface of the cylinder liner, allowing no more than 8 hours to pass, and positioning the cylinder liner in a mold and over-casting a cylinder block in the mold.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
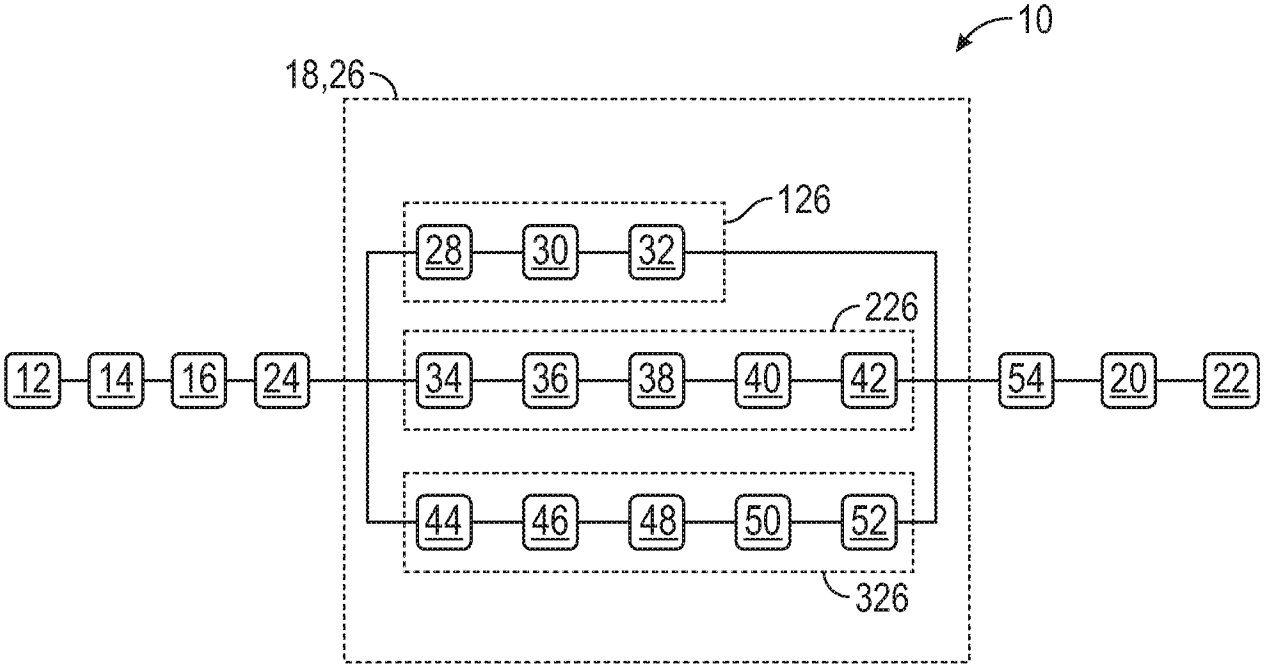
FIG. 1 is a flow chart of a method according to an exemplary embodiment.

Referring to FIG. 1, a method 10 of manufacturing a cylinder block for an engine comprises providing 12 a cylinder liner for the cylinder block and keeping 14 the cylinder liner in a controlled atmosphere, removing 16 the cylinder liner from the controlled atmosphere, removing 18 moisture and gaseous contamination from the cylinder liner, and positioning 20 the cylinder liner in a mold and over-casting 22 a cylinder block in the mold.

The cylinder block is made of an aluminum alloy that provides the strength and durability necessary for the cylinder block. The aluminum alloy provides a cylinder block that is much lighter than traditional cast iron cylinder blocks.

Moisture and gaseous contamination is absorbed into cast iron and steel from the atmosphere. For this reason, when cast iron or steel cylinder liners are provided for use in an aluminum block the cylinder liners are provided in sealed packaging to provide a controlled atmosphere and prevent the cylinder liner from being exposed to moisture and gaseous contamination prior to being cast into an engine block. It is important that the cylinder liners remain in the controlled environment for as long as possible and only exposed to open air just prior to being cast into an engine block.

Imperfections in the packaging, or expiration of the life span of the packaging, may result in the presence of moisture and gaseous contamination in a new cylinder liner. Additionally, once the cylinder liner is removed from the controlled environment of the packaging the cylinder liner is exposed to the air prior to being cast into an engine block.

Further, because the cylinder liners are easily recovered from non-poured casting molds, thermal sand reclamation, or damaged or used engine blocks, it is possible that the cylinder liner is being re-used. All of these factors contribute to the possible presence of moisture and gaseous contamination within the cylinder liners and possible oxidation and scale on the surface of the cylinder liners.

Prior to removing 18 moisture and gaseous contamination from the cylinder liner, the surface of the cylinder liner is treated 24. Surface treating 24 the cylinder liner is important to remove scale and oxidation that may have formed on the surface of the cylinder liner. In an exemplary embodiment of the present method, the surface of the cylinder liner is shot blasted. Shot blasting 24 the surface of the cylinder liner effectively removes scale and oxidation from the cylinder liner. Further, the shot blasting 24 opens up graphite flakes in the micro-structure of the cast iron or steel to allow moisture and gaseous contamination to more easily be removed 18 from the cylinder liner.

After shot blasting 24, removing 18 moisture and gaseous contamination from the cylinder liner is accomplished by thermal processing 26 the cylinder liner. Heating 26 the cylinder liner vaporizes any moisture that may be present within the cast iron cylinder liner. Heating 26 the cylinder liner also promotes migration of vaporized moisture and other gasses from the cast iron cylinder liner. The advantage of the shot peening 24 process is emphasized here. With the graphite flakes within the micro-structure of the cast iron or steel opened up, the gasses are able to freely migrate from the cast iron or steel. This improves the effectiveness of the thermal processing 26 and provides more efficient removal 18 of moisture and gaseous contamination within the cylinder liner.

In an exemplary embodiment the thermal processing 26 takes place in a controlled atmosphere. The thermal processing 26 is meant to remove 18 moisture and gaseous contamination from the cast iron cylinder liner. The presence of moisture and gaseous contamination within the atmosphere during heat treatment 26 may impair the removal 18 of moisture and gaseous contamination during the heat treatment 26. The thermal processing 26 of the cylinder liners may be performed in an oven that provides a controlled environment during thermal processing 26. Further, during the thermal processing 26 moisture and gasses can be continuously removed from the atmosphere within the oven. This will allow effective removal 18 of the moisture and gaseous contamination from the cylinder liner, and prevent such moisture and gaseous contamination from migrating back into the cylinder liner.

Figure 2:
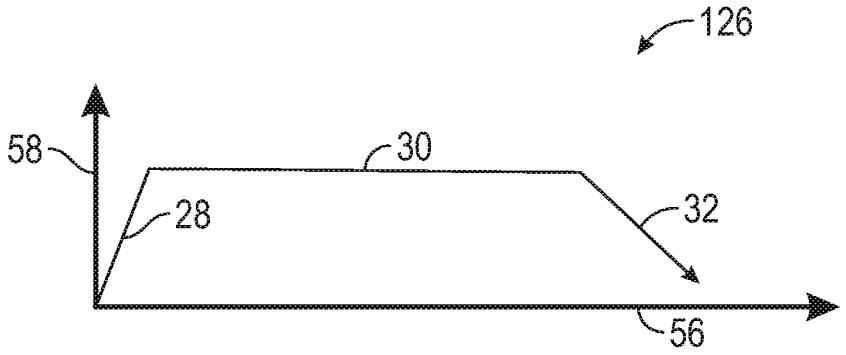
FIG. 2 is a chart illustrating thermal processing according to an exemplary embodiment.

In an exemplary embodiment thermal processing 126 includes the steps of heating 28 the cylinder liner to a temperature between about 200 degrees Celsius and about 260 degrees Celsius, holding 30 the cylinder liner at a temperature between about 200 degrees Celsius and about 260 degrees Celsius for at least 6 hours, and cooling 32 the cylinder liner to room temperature. This heat treatment 126 is illustrated in the chart of FIG. 2, wherein the x-axis 56 represents time and the y-axis 58 represents temperature.

Figure 3:
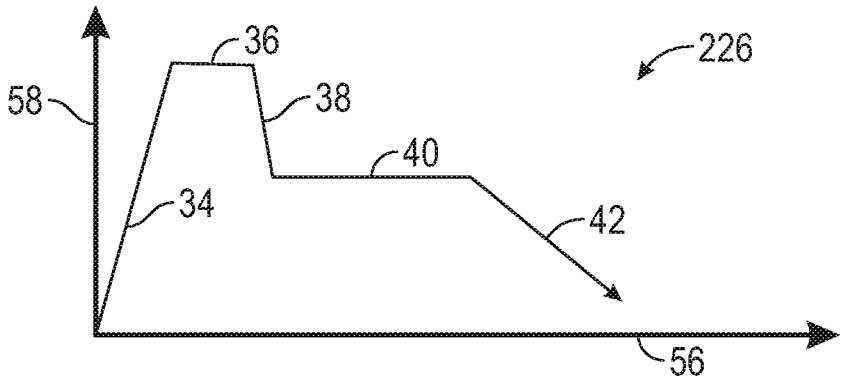
FIG. 3 is a chart illustrating thermal processing according to another exemplary embodiment.

In another exemplary embodiment, thermal processing 226 includes the steps of heating 34 the cylinder liner to a temperature between about 400 degrees Celsius and 450 degrees Celsius and holding 36 the cylinder liner at a temperature between about 400 degrees Celsius and about 450 degrees Celsius for at least 1 hour. The cylinder liner is then cooled 38 to a temperature between about 200 degrees Celsius and about 260 degrees Celsius and held 40 at a temperature between about 200 degrees Celsius and about 260 degrees Celsius for at least 2 hours. The cylinder liner is then cooled 42 to room temperature. This boosted two-stage heat treatment process provides the same effectiveness in removing the moisture and gaseous contamination from the cylinder liner but does so in a shorter time period. This heat treatment 226 is illustrated in the chart of FIG. 3, wherein the x-axis 56 represents time and the y-axis 58 represents temperature.

Figure 4:
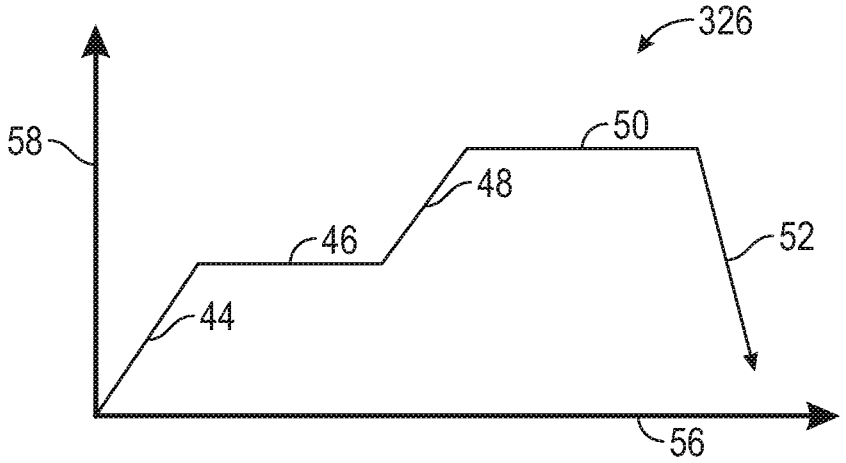
FIG. 4 is a chart illustrating thermal processing according to yet another exemplary embodiment.

In another exemplary embodiment, thermal processing 326 includes the steps of heating 44 the cylinder liner to a temperature between about 200 degrees Celsius and about 260 degrees Celsius and holding 46 the cylinder liner at a temperature between about 200 degrees Celsius and about 260 degrees Celsius for at least 1 hour. The cylinder liner is then further heated 48 to a temperature between about 400 degrees Celsius and about 450 degrees Celsius and held 50 at a temperature between about 400 degrees Celsius and about 450 degrees Celsius for at least 1 hour. The cylinder liner is then cooled 52 to room temperature. This boosted two-stage heat treatment 326 provides the same effectiveness in removing 18 the moisture and gaseous contamination from the cylinder liner but does so in an even shorter over-all time period by providing higher temperature heat treatment in a second stage after heat treatment at a lower temperature. This heat treatment 326 is illustrated in the chart of FIG. 4, wherein the x-axis 56 represents time and the y-axis 58 represents temperature.

In still another exemplary embodiment, thermal processing includes the steps of heating 44 the cylinder liner to a temperature between about 220 degrees Celsius and about 225 degrees Celsius and holding 46 the cylinder liner at a temperature between about 220 degrees Celsius and about 225 degrees Celsius for at least 1 hour. The cylinder liner is then further heated 48 to a temperature between about 420 degrees Celsius and about 425 degrees Celsius and held 50 at a temperature between about 420 degrees Celsius and about 425 degrees Celsius for at least 1 hour. The cylinder liner is then cooled 52 to room temperature.

After removing 18 moisture and gaseous contamination from the cylinder liner, the surface of the cylinder liner is again treated 54. Surface treating 54 the cylinder liner is important to remove scale and oxidation that may have formed on the surface of the cylinder liner during the heat treatment process. In an exemplary embodiment of the present method, the surface of the cast iron cylinder liner is shot blasted. Shot blasting 54 the surface of the cylinder liner effectively removes scale and oxidation from cylinder liner.

After thermal processing 26 and surface treatment 54 of the cylinder liner, the cylinder liner is positioned 20 within a mold and the aluminum engine block is over-casted 22 onto the cylinder liners within the mold. In a non-limiting example, the cylinder liner is supported on a decomposable sand-type core within a casting cavity of an engine block casting mold or on a metal mandrel in a die cavity in permanent mold or high pressure die casting with an outer surface of the cylinder liner exposed for cast-in-place joinder with the aluminum cylinder block.

As soon as the cylinder liner is exposed to air after thermal processing 26 and surface treatment 54 process, it is possible for moisture and gasses to migrate into the micro-structure of the cast iron or steel. It is also possible for oxidation and scale to begin forming on the surface of the cylinder liner. Therefore, it is important that the cylinder liner is cast 22 into an engine block soon after the heat treatment and surface treatment processes. It is preferable to perform the casting process 22 within approximately 4 hours after the second surface treatment 54, and preferably no more than 8 hours pass between the second surface treatment 54 of the cylinder liner and the casting process 22.

The method of the present disclosure offers several advantages. The method of the present disclosure provides a process to create aluminum engine blocks with cast-in-place iron cylinder liners that minimizes the likelihood of failures in the finished engine blocks due to gas bubbles in the aluminum engine block. Further, minimizing the migration of gasses from the cast iron cylinder liner reduces the risk that such gasses may become trapped between the cylinder liner and the aluminum engine block impairing the mechanical bond and layup between the cylinder liner and the engine block.

The term "about" as used herein is known to those skilled in the art. Alternatively, the term "about" may be read to mean plus or minus 10 degrees Celsius. The term "approximately" as used herein is known to those skilled in the art. Alternatively, the term "approximately" may be read to mean plus or minus 20 minutes.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method of thermal processing a cylinder liner for an engine comprising:

surface treating the cylinder liner;

removing moisture and gaseous contamination from the cylinder liner by thermal processing the cylinder liner with a two-step heat-treatment in a controlled atmosphere by:

heating the cylinder liner to a temperature between about 400 degrees Celsius and about 450 degrees Celsius;

holding the cylinder liner at the temperature between about 400 degrees Celsius and about 450 degrees Celsius for at least approximately 1 hour;

cooling the cylinder liner to a temperature between about 200 degrees Celsius and about 260 degrees Celsius;

holding the cylinder liner at the temperature between about 200 degrees Celsius and about 260 degrees Celsius for at least approximately 2 hours; and allowing the cylinder liner to cool to room temperature; and surface treating the cylinder liner.

2. The method of claim 1, wherein surface treating the cylinder liner prior to removing moisture and gaseous contamination from the cylinder liner further includes shot blasting a surface of the cylinder liner.

3. The method of claim 1, wherein surface treating the cylinder liner after removing moisture and gaseous contamination from the cylinder liner further includes shot blasting a surface of the cylinder liner.

4. A method of thermal processing a cylinder liner for an engine comprising:

surface treating the cylinder liner;

removing moisture and gaseous contamination from the cylinder liner by thermal processing the cylinder liner with a two-step heat-treatment in a controlled atmosphere by:

heating the cylinder liner to a temperature between about 200 degrees Celsius and about 260 degrees Celsius;

holding the cylinder liner at the temperature between about 200 degrees Celsius and about 260 degrees Celsius for at least approximately 1 hour;

heating the cylinder liner to a temperature between about 400 degrees Celsius and about 450 degrees Celsius;

holding the cylinder liner at the temperature between about 400 degrees Celsius and about 450 degrees Celsius for at least approximately 1 hour; and allowing the cylinder liner to cool to room temperature; and surface treating the cylinder liner.

5. The method of claim 4, wherein surface treating the cylinder liner prior to removing moisture and gaseous contamination from the cylinder liner further includes shot blasting a surface of the cylinder liner.

6. The method of claim 4, wherein surface treating the cylinder liner after removing moisture and gaseous contamination from the cylinder liner further includes shot blasting a surface of the cylinder liner.

7. A method of manufacturing a cylinder block for an engine comprising:

providing a cylinder liner for the cylinder block and keeping the cylinder liner in a controlled atmosphere;

removing the cylinder liner from the controlled atmosphere;

shot blasting a surface of the cylinder liner;

removing moisture and gaseous contamination from the cylinder liner by thermal processing the cylinder liner with a two-step heat treatment in the controlled atmosphere according to one of: heating the cylinder liner to a temperature between about 400 degrees Celsius and about 450 degrees Celsius for at least approximately 1 hour, cooling the cylinder liner to a temperature between about 200 degrees Celsius and about 260 degrees Celsius for at least approximately 2 hours, and returning to room temperature; and heating the cylinder liner to a temperature between about 200 degrees Celsius and about 260 degrees Celsius for at least approximately 1 hour, further heating the cylinder liner to a temperature between about 400 degrees Celsius and about 450 degrees Celsius for at least approximately 1 hour, and cooling the cylinder liner to room temperature;

shot blasting the surface of the cylinder liner;

allowing no more than approximately 8 hours to pass; and positioning the cylinder liner in a mold and over-casting a cylinder block in the mold.

* * * * *